United States Patent [19]

Ichikawa et al.

[11] 4,231,565

[45] Nov. 4, 1980

[54] PAPER FEED DEVICE

[75] Inventors: Junji Ichikawa, Kawasaki; Yuji Takahashi, Tokyo; Jun Saito, Kawasaki, all of Japan

[73] Assignee: Canon Kabushiki Kaisha, Tokyo, Japan

[21] Appl. No.: 849,628

[22] Filed: Nov. 8, 1977

[30] Foreign Application Priority Data

| | | | |
|---|---|---|---|
| Nov. 12, 1976 | [JP] | Japan | 51-135982 |
| Nov. 12, 1976 | [JP] | Japan | 51-135983 |
| Nov. 12, 1976 | [JP] | Japan | 51-135984 |
| Nov. 12, 1976 | [JP] | Japan | 51-135985 |
| Nov. 12, 1976 | [JP] | Japan | 51-135986 |

[51] Int. Cl.[2] ..... B65H 3/48; B65H 3/56

[52] U.S. Cl. ..... 271/105; 271/126; 271/164; 271/170

[58] Field of Search ..... 271/105, 97, 98, 104, 271/126, 170, 164, 30 R

[56] References Cited

U.S. PATENT DOCUMENTS

| | | | |
|---|---|---|---|
| 1,628,224 | 5/1927 | Bradshaw | 271/105 |
| 2,163,274 | 6/1939 | Dixon | 271/106 |
| 3,301,551 | 1/1967 | Cassano et al. | 271/170 X |
| 3,713,645 | 1/1973 | Ferrari et al. | 271/170 |
| 3,887,178 | 6/1975 | Fujimoto | 271/30 R |

FOREIGN PATENT DOCUMENTS

| | | | |
|---|---|---|---|
| 2240161 | 3/1973 | Fed. Rep. of Germany | 271/98 |

*Primary Examiner*—Bruce H. Stoner, Jr.

*Attorney, Agent, or Firm*—Fitzpatrick, Cella, Harper & Scinto

[57] ABSTRACT

In a paper feed device having a storage for storing thereon a pile of paper leaves and a device for feeding the paper leaves piled on the storage, there is provided separating apparatus for separating an uppermost one of the paper leaves to be fed by the feeding device from the other paper leaves and a blower disposed adjacent to the rear end of the piled paper leaves with respect to the direction of the feed thereof for blowing a flow of pressurized fluid in the direction of feed of the paper leaves. The blower is movable for retraction with respect to the rear end of the piled paper leaves.

1 Claim, 16 Drawing Figures

PAPER FEED DEVICE

BACKGROUND OF THE INVENTION

1. Field of the Invention

This invention relates to a paper feed device for feeding paper to the copying mechanism portion of a copying machine, the recording mechanism portion of a recording machine or the printing mechanism portion of a printing machine, and more particularly to a paper feed device for storing paper sheets cut to a predetermined size (hereinafter referred to as paper leaves) and feeding a predetermined number of the paper leaves in succession.

2. Description of the Prior Art

The high-speed copying machine or the recording or printing machine for recording the output from an electronic computer consumes a great deal of paper during a very short time and in this connection, it is desirable that the paper feed device thereof be capable of storing a great deal of paper leaves.

Even in the paper feed device for storing therein so great a supply of paper leaves, the great storage capacity would be of little value if the paper leaves fail to be fed accurately one by one from the paper feed device.

This is because, if a plurality of paper leaves should be fed at a time (this is known as overlap feed), these paper leaves would jam in the recording mechanism portion or the like to give rise to the trouble of stopping operation of the mechanism for removal of the jam, which would take much time.

Also, when overlap feed occurs, blank or unprinted paper leaves may mix among printed paper leaves to hamper the paging of the paper leaves.

The paper feed device of the prior art has employed means such as separating pawls or the like for separating each paper leaf from the others, whereas this could not afford sufficient separability between the paper leaves and suffered from the possibility of overlap feed.

SUMMARY OF THE INVENTION

It is an object of the present invention to provide a paper feed device which ensures paper leaves to be fed accurately one by one from a storage storing therein a pile of paper leaves.

It is another object of the present invention to provide a paper feed device in which a flow of pressurized fluid is blown from a nozzle or the like against a pile of paper leaves in the storage to impart separability to the piled paper leaves and feed them one by one.

It is still another object of the present invention to provide a paper feed device in which a flow of pressurized fluid is blown in the direction of feed of the paper leaves.

It is yet still another object of the present invention to provide a paper feed device in which the nozzle is retractable from the path of paper supply to the storage.

It is a further object of the present invention to provide a paper feed device in which the nozzle is provided on the door member of the storage.

It is a further object of the present invention to provide a paper feed device in which the flow of pressurized fluid from the nozzle is stopped when the feed of paper leaves is started.

It is a further object of the present invention to provide a paper feed device in which the separating pawl provided to press and restrain one end of the piled paper leaves with a predetermined pressure force to ensure each paper leaf to be fed is movable in the direction of feed of the paper leaves.

It is a further object of the present invention to provide a paper feed device in which a discharge portion for the fluid passed between paper leaves after being blown from the nozzle is provided in opposed relationship with the nozzle.

It is a further object of the present invention to provide a paper feed device in which that surface of a front plate forming the storage which faces the pile of paper leaves is flush with that surface of the separating pawl which faces the paper leaves.

Thus, the present invention provides an improved paper feed device to ensure that the piled paper leaves be given separability and to impart a proper separating action to such paper leaves, and will become more fully apparent from the following detailed description thereof taken in conjunction with the accompanying drawings.

DESCRIPTION OF THE PREFERRED EMBODIMENTS

Figure 1:
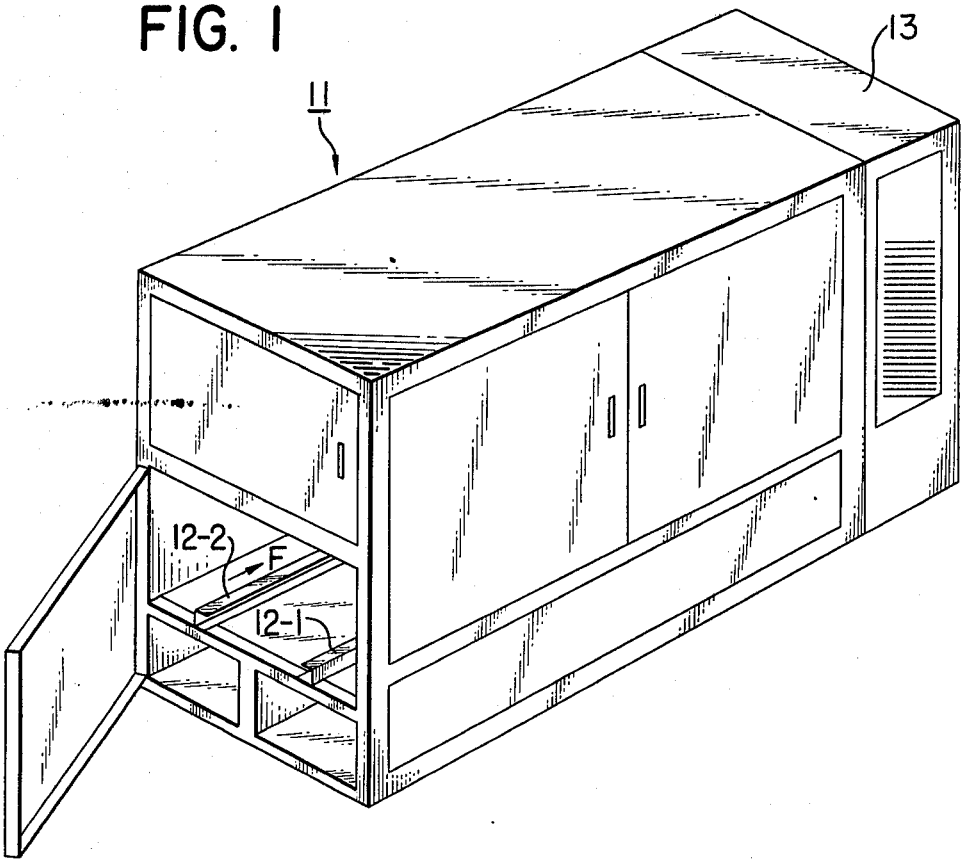
FIG. 1 is a pictorial, perspective view of a laser beam printer to which the present invention is applied.

Referring to FIG. 1, it is a pictorial view of a laser beam printer to which the present invention is applied. Such a printer is disclosed, for example, in Pat. No. 4,059,833 wherein output information from an electronic computer scans over a photosensitive drum and the information so recorded on such photosensitive drum is developed and transferred to and fixed on a leaf of paper supplied from a paper feed device.

Figure 2B:
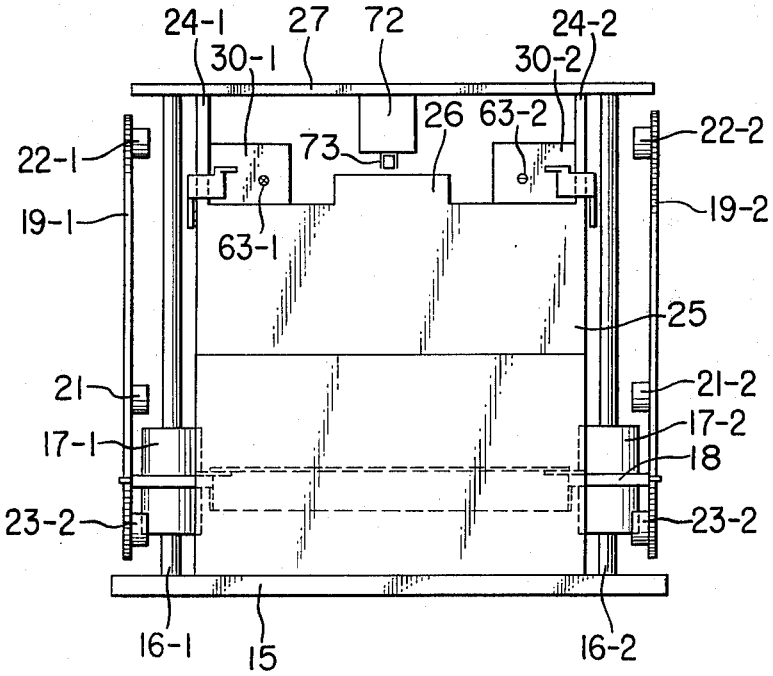
FIGS. 2A and 2B generally show the paper feed device according to the present invention, FIG. 2A being a perspective view and FIG. 2B being a front view of the device as seen in the direction of arrow B in FIG. 2A.
Figure 2A:
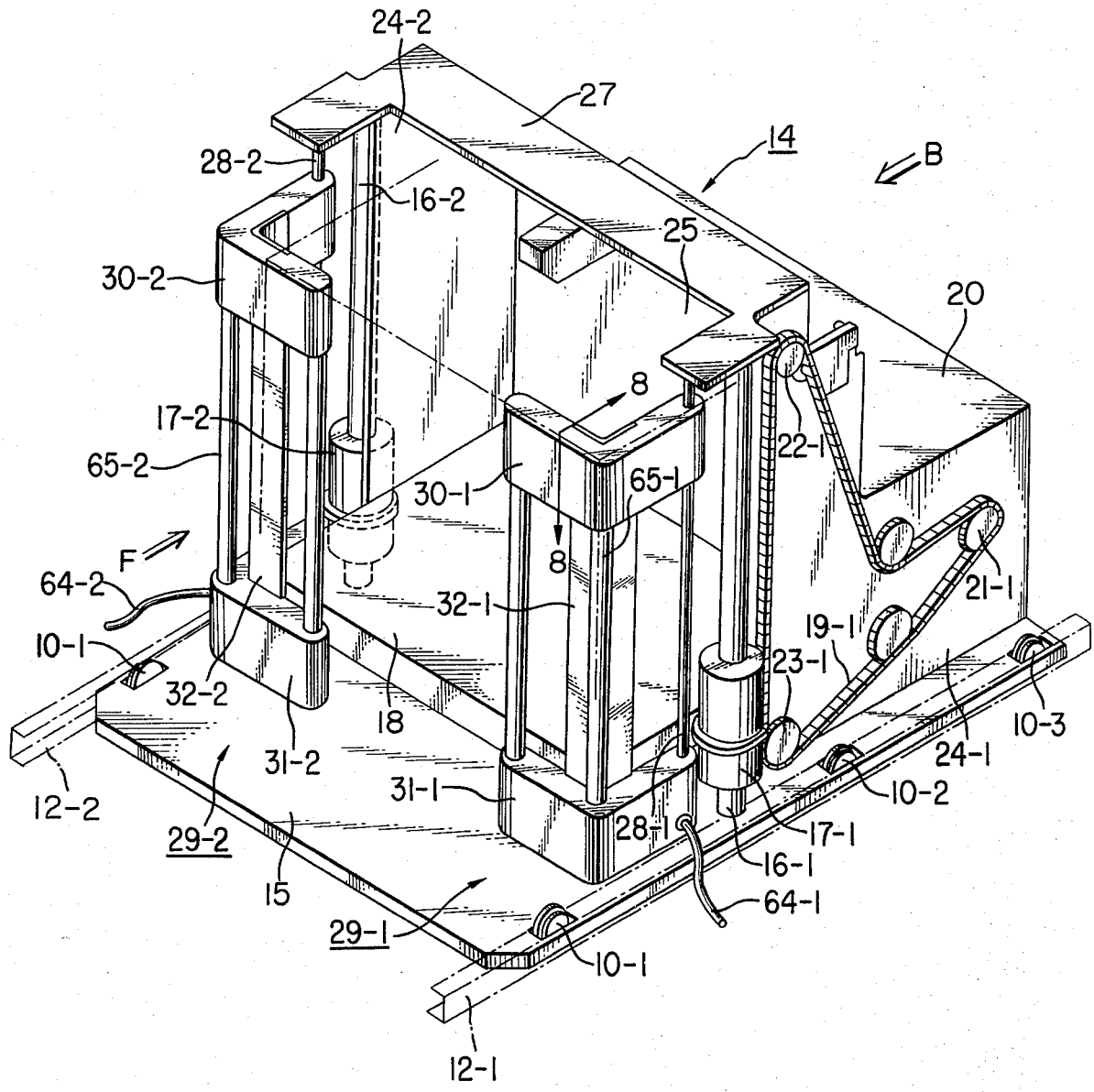

Designated by 11 in FIG. 1 is a laser beam printer housing containing therein the printer as described above. As seen with the door open, two parallel rails 12-1, 12-2 are installed within a portion of such housing and, as shown in FIG. 2A, a paper feed device is movably disposed between these rails. The paper feed device, when fully moved in the direction of arrow F along the rails 12-1, 12-2, assumes its paper feeding position and, when moved in the anti-F direction, assumes a position in which the paper leaf storage of the paper feed device may be manually or otherwise replenished with paper leaves. Recording paper, once recorded by such printer 11, may be discharged rightwardly, as viewed in the drawing, for storage in a stacker 13 (FIG. 1).

FIG. 2A shows the paper feed device 14 disposed between the rails 12-1, 12-2 shown in FIG. 1. Such paper feed device 14 has a flat bed 15 on which all members of the device rest. The bed 15 has three pairs of wheels 10-1 to 10-3 (some of which are not seen) provided in bilateral symmetry, and these wheels may roll in the rails.

Such bed 15 is movable by a motor, not shown, in the direction of arrow F or in the anti-F direction, as already noted. At least two microswitches are fixedly provided on portions of the housing 11. One of the microswitches is operative to stop the motor when the bed 15 moving in the direction of arrow F has arrived at the aforementioned paper feeding position, and the other microswitch is operative to stop the motor after the wheels 10-1 have run off the rails 12-1, 12-2 with the movement of the bed 15 in the anti-F direction but immediately before the wheels 10-2 run off the rails, thereby permitting the paper leaf storage to be replenished with paper leaves.

A pair of struts 16-1 and 16-2 are studded substantially on the bed 15. A movable member 17 is vertically movably mounted on each of the struts. A movable bed 18 for supporting thereon a number of paper leaves to be fed is secured to the two movable members 17-1, 17-2.

The size of the movable bed 18 is substantially equal to the size of each paper leaf to be supported thereon.

As noted above, the movable bed 18 is secured to the movable members 17-1 and 17-2, so that simultaneous upward or downward movements of the movable members may result in upward or downward movement of the movable bed 18.

For such a purpose, chains 19-1 and 19-2 are provided. Each chain 19 is wrapped about a gear 21 driven from an unshown motor housed in an accommodation 20 and passes over guide gears 22 and 23 provided adjacent to the upper and lower end of each strut 16, respectively, a portion of the chain being secured to associated one of the aforementioned movable members 17.

Although the chain and gears on the strut 16-2 side are not shown in FIG. 2A, it should be understood that similar chain and gears are provided to move the movable member 17-2 just in the same manner as described with respect to the movable member 17-1, and such chain and gears are designated with suffix number 2 added. In FIG. 2B, such chains and gears are depicted separately from the side plates 24 to clearly illustrate them.

Thus, by mounting the gears 21-1 and 21-2 on a common shaft and driving them at an equal speed simultaneously, the movable bed 18 may be parallel-moved upwardly or downwardly.

The opposite side plates 24-1 and 24-2 to which gears 21-1, 22-1, 23-1 and gears 21-2, 22-2, 23-2 are mounted serve also as the side plates for constituting the paper leaf storage and for such purpose, the distance between the opposed surfaces of the side plates 24-1 and 24-2 is chosen to a value substantially equal to the length of each paper leaf and these side plates are secured to the aforementioned bed 15.

A front plate 25 forming a part of the paper leaf storage is disposed between the side plates 24-1 and 24-2 and substantially vertically with respect to the bed 15. This front plate 25 has a projected portion 26 formed centrally thereof, as will further be described.

The tops of the struts 16-1, 16-2 and side plates 24-1, 24-2 are substantially flush with one another and a top plate 27 is secured to these tops to fix the relative position therebetween.

Further struts 28-1 and 28-2 are provided between the top plate 27 and the bed 15 and substantially vertically fixed to the bed 15. L-shaped keep members 29-1 and 29-2 are pivotally secured to such struts 28-1 and 28-2, respectively.

The keep member 29-1 is biased counter-clockwisely about the struct 28-1 and the keep member 29-2 is biased clockwisely about the strut 28-2, each by unshown spring, and restrained in their positions as shown in FIG. 2A. When the paper leaf storage is to be replenished with paper leaves, the keep members 29-1 and 29-2 may be opened by being pivoted counter-clockwise and clockwise, respectively, and once the replenishment is completed, the keep members assume their positions shown in FIG. 2A to prevent displacement of the paper leaves piled in the storage.

More specifically, right-angled members 32-1 and 32-2 of right-angled cross-section extend between and are secured to upper and lower L-shaped members 30-1, 31-1 and 30-2, 31-2 forming the keep members. In the position as shown in FIG. 2A, the side plates 24-1, 24-2, front plate 25 and right-angled members 32-1, 32-2 together constitute a space substantially corresponding to the volume of the piled paper leaves, and such space provides the paper leaf storage.

Figure 3:
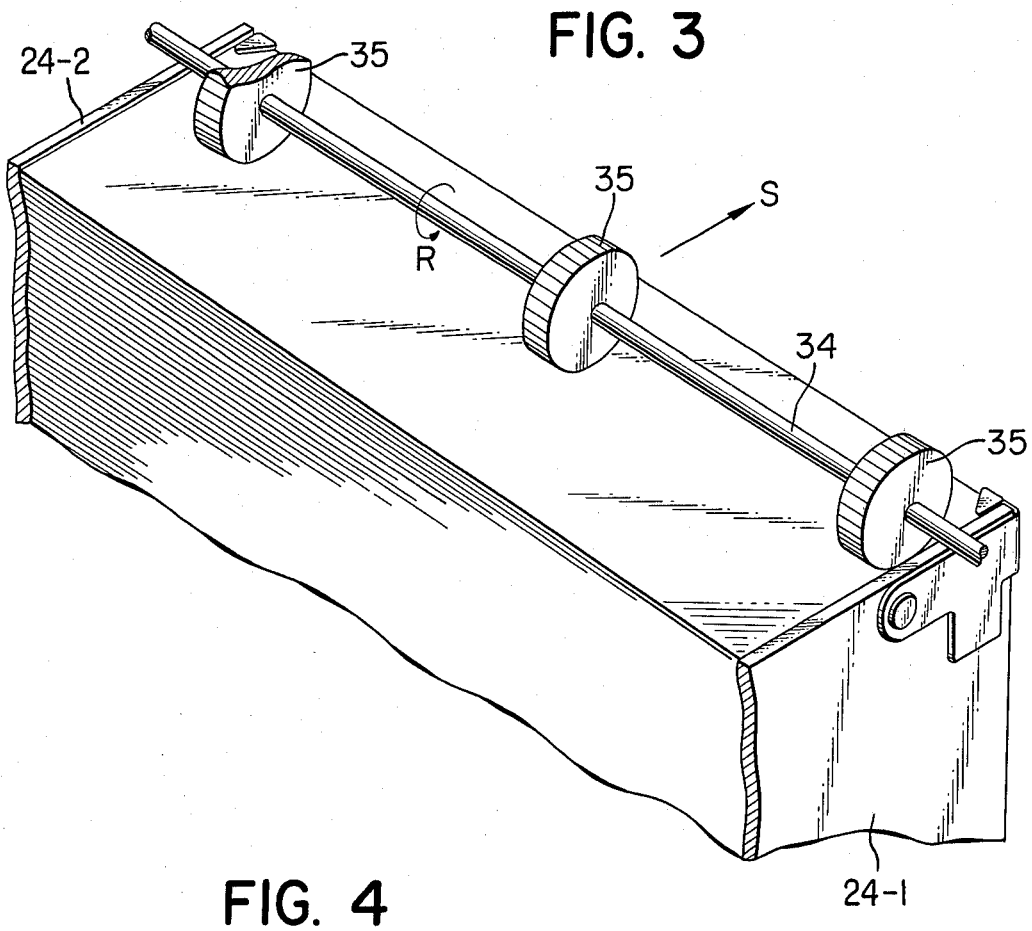
FIG. 3. is a perspective view of essential portions of the storage for generally illustrating the paper feed.

To enable paper leaves to be fed one by one from such storage, rollers 35 (FIG. 3) formed of rubber or like material are securely mounted on a shaft 34 driven from an unshown motor and these rollers are designed to be urged against the top of a pile of paper leaves while the shaft 34 is driven in the direction of arrow R, thereby feeding an uppermost one of the piled paper leaves in the direction of arrow S.

The present invention pertains to a mechanism for accurately feeding the paper leaves one by one in such a case. Such mechanism will hereinafter be described.

Figure 4:
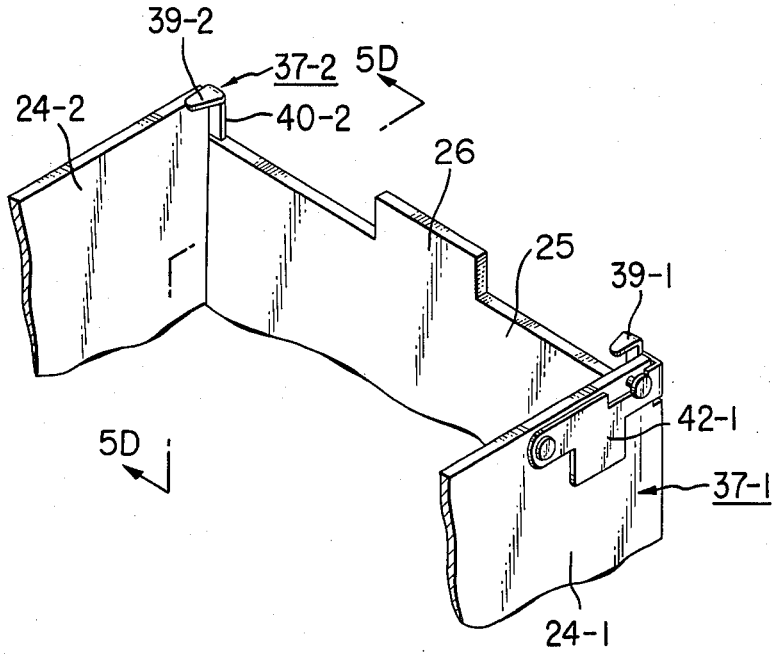
FIG. 4 is an enlarged view of essential portions of the storage provided with separating pawls.

FIG. 4 shows the aforementioned storage in greater detail. In such a construction, separating pawls 37-1 and 37-2 are secured to the ends of the opposite side plates 24-1 and 24-2, respectively.

The function of the separating pawls themselves is well-known and need not be described in detail herein, but according to the present invention, the relation between the separating pawls 37-1, 37-2 and the front plate 25 is chosen to reduce the possibility of overlap feed.

Figure 5A:
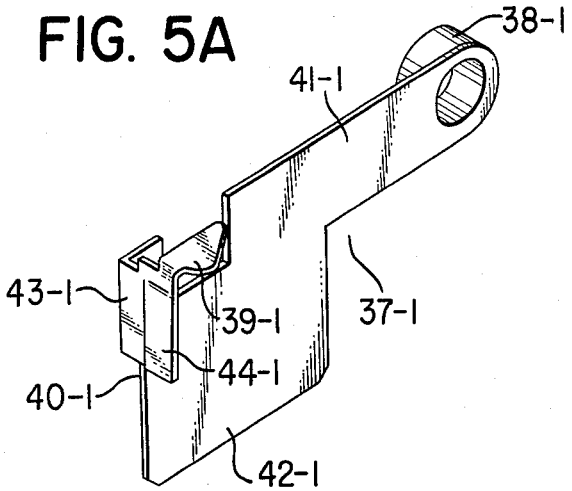
FIGS. 5A and 5B are perspective views of a separating pawl.
Figure 5B:
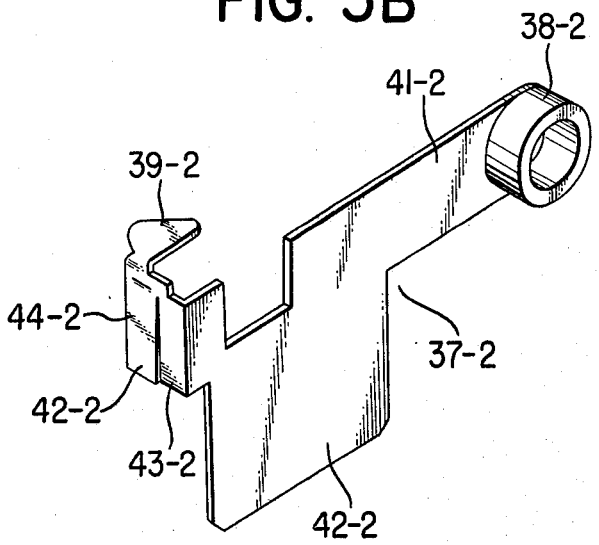

Such separating pawls 37-1 and 37-2, as shown in FIGS. 5A and 5B, respectively comprise mount portions 38-1 and 38-2 pivotally mounted on side plates 24-1, 24-2, pawls 39-1 and 39-2 to be urged against the uppermost paper leaf in the paper leaf storage, restricting portions 40-1 and 40-2 for restricting the front edges of the paper leaves in the storage, arms 41-1 and 41-2, and overlap portions 42-1 and 42-2.

Figure 5C:
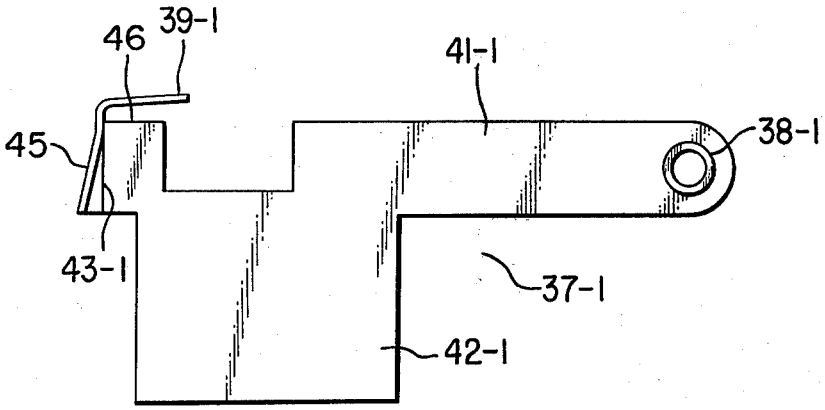
FIG. 5C is a side view of the separating pawl.

The restricting portions 40-1 and 40-2 respectively comprise side-plate-facing portions 43-1, 43-2 which face the side plates and paper-leaf-facing portions 44-1, 44-2 which face the paper leaves. As seen in FIG. 5C, the paper-leaf-facing portions 44 each comprise an inclined portion 45 and a flat portion 46.

Figure 5D:
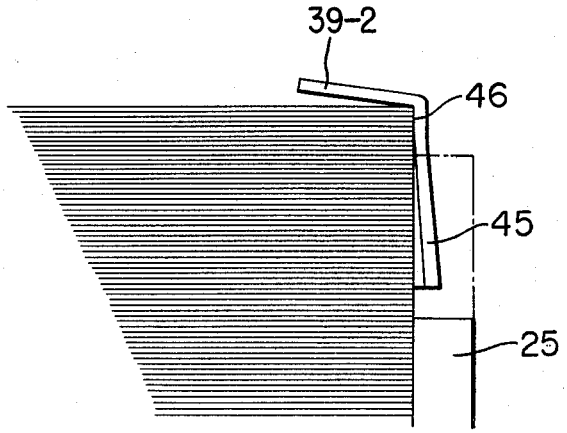
FIG. 5D is a side view of the storage for illustrating the operation of the separating pawl.

As shown in FIG. 5D, that side of the front plate 25 which faces the paper leaf storage is formed as a flat surface, on the extension of which is located the flat portion 46 of the paper-leaf-facing portion 44.

Figure 6A:
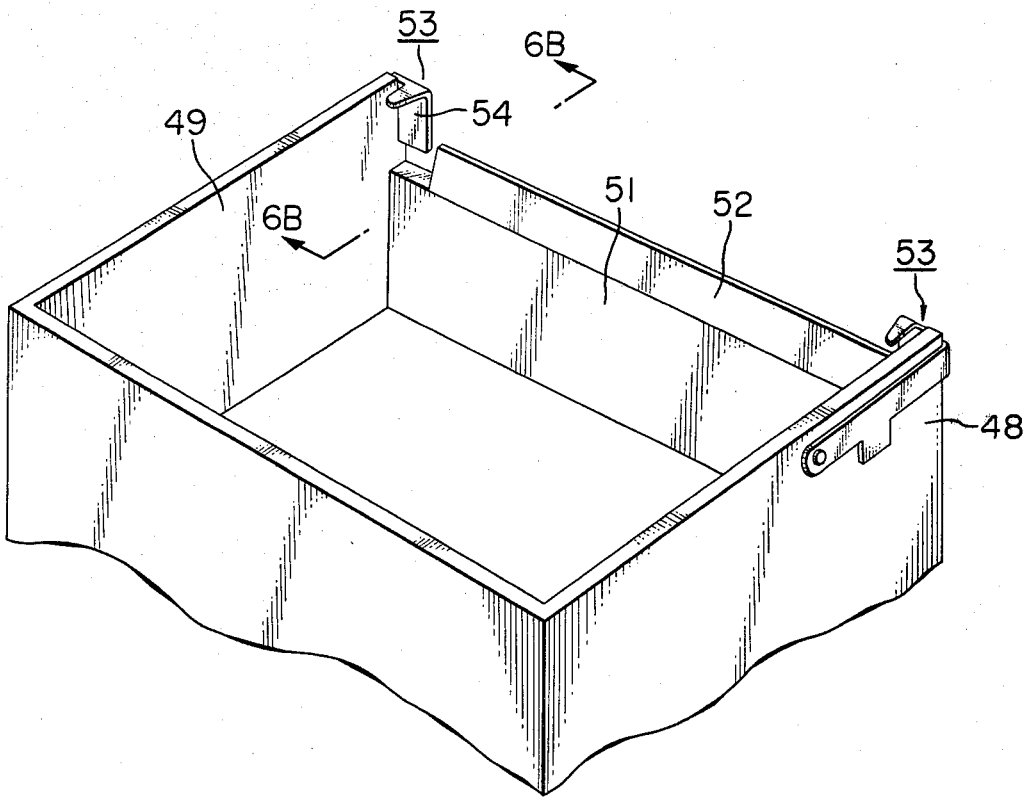
FIG. 6A PRIOR ART
FIGS. 6A and 6B show the paper feed device according to the prior art, FIG. 6A being a perspective view and FIG. 6B being a cross-sectional view taken along line 6B—6B in FIG. 6A.

In the paper feed device heretofore used, as shown in FIG. 6A, the space defined by side plates 48, 49, front plate 51 and the back plate 50 served as the storage for piled paper leaves and replenishment of the storage with paper leaves was done from the front plate side, and for this purpose, an inclined portion 52 was provided on top of the front plate 51 to permit paper leaves to be smoothly inserted into the bottom of the storage.

Figure 6B:
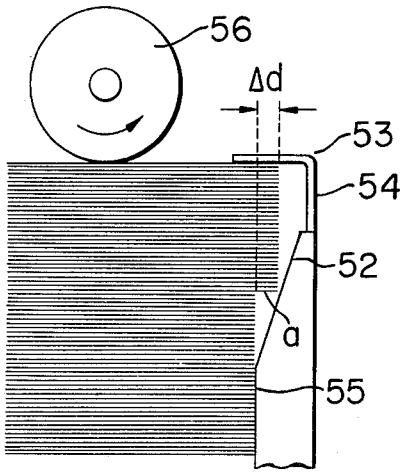
FIG. 6B PRIOR ART

Therefore, a separating pawl 53 was provided and the paper-leaf-facing portion 54 for restricting the front edges of the paper leaves in the storage was disposed so as to lie above the inclined portion 52, as shown in FIG. 6B. In other words, the paper-leaf-facing portion 54 did not lie on the extension of the surface 55 of the front plate 51.

Thus, if there was a slippery surface between piled paper leaves in the storage which were to be fed one by one from the uppermost paper leaf by a roller 56, as shown in FIG. 6B, then that amount of paper leaves piled above such slippery surface as indicated by a was bodily displaced by $\Delta d$ and when the slippery surface a came to occupy the level near the uppermost paper leaf, such slippery surface a caused some paper leaves near it to be fed in overlapped relationship at a time although only the then uppermost paper leaf had to be fed. In contrast, according to the present invention, part of the paper-leaf-facing portions of the separating pawls lies on the extension of the plane formed by the front plate and this is useful to prevent the displacement of the paper leaves as shown at a in FIG. 6B, thus reducing the possibility of overlap feed.

Figure 7A:
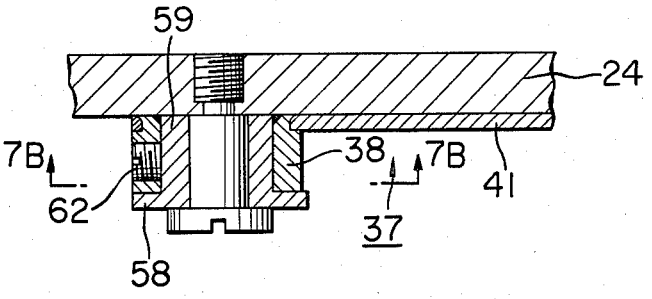
FIGS. 7A and 7B are a cross-sectional view and a front view, respectively, for illustrating the pivot axis of the separating pawl.
Figure 7B:
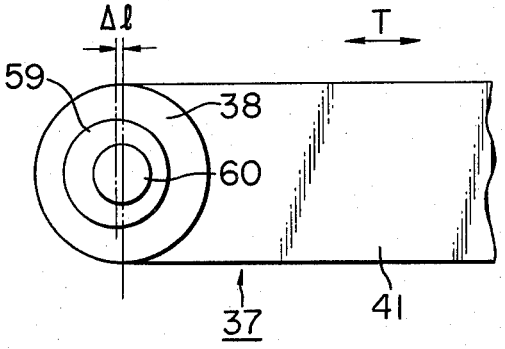

FIG. 7 illustrates the manner in which the separating pawls 37-1, 37-2 as described are mounted on the side plates 24-1, 24-2. Since it is desirable that the separating pawls used with the present invention be accurately adjusted so as to assume the position as shown in FIG. 5D, the pivot axis of each separating pawl is made adjustable to thereby render the arm 41 adjustable back and forth along the respective side plate 24.

More specifically, the mount portion 38 of each separating pawl comprises a cylindrically shaped metal member and the arm 41 is mounted to the mount portion 38 by caulking. An insert member 59 having a flange 58 is inserted in the mount portion 38. The insert member 59 has its external portion formed as a cylinder insertable in the mount portion 38, and is provided with an eccentric bore 60 therethrough.

A screw 61 may be inserted in the bore 60 to secure the separating pawl to the respective side plate, whereafter the insert member 59 may be turned to thereby displace the pivot axis of the arm 41. In other words, the arm 41 may be displaced in the direction of arrow T to thereby adjust the position of the paper-leaf-facing portion 44 of the separating pawl. Once the optimum position for the pivot axis of the arm 41 has been so located by turning the insert member 59, a screw 62 may be threaded into a threaded hole provided in the mount portion 38 to thereby secure the mount portion 38 and the insert member 59 as a unit, thereby fixing the position of the pivot axis of the arm 41.

It is now recalled that a number of paper leaves are piled in the storage, as already noted. Such piled paper leaves should desirably be given separability therebetween, so as to ensure them to be fed accurately one by one.

In the paper feed device of the present invention, the L-shaped members 30-1 and 30-2 shown in FIG. 2A are provided with nozzles 63-1 and 63-2, respectively, through which pressurized air may be blown to give separability to the piled leaves. These nozzles are at fixed locations, but the movable bed 18 is progressively moved up as the number of the paper leaves in the storage is decreased, with a result that the air from the nozzles are blown against all portions of the piled paper leaves to impart separability to them.

Supply of the air to these nozzles is effected through flexible pipes 64-1 and 64-2. Such pipes respectively pass through the L-shaped members 31-1, 31-2, struts 65-1, 65-2 and L-shaped members 30-1, 30-2 and come into contact with the respective nozzles 63-1 and 63-2.

The locations whereat these nozzles are disposed are determined in the relation to the aforementioned front plate 25, but as shown in FIG. 2B, they are selected to the level of the upwardly projected portion 26 of the front plate 25.

Figure 8:
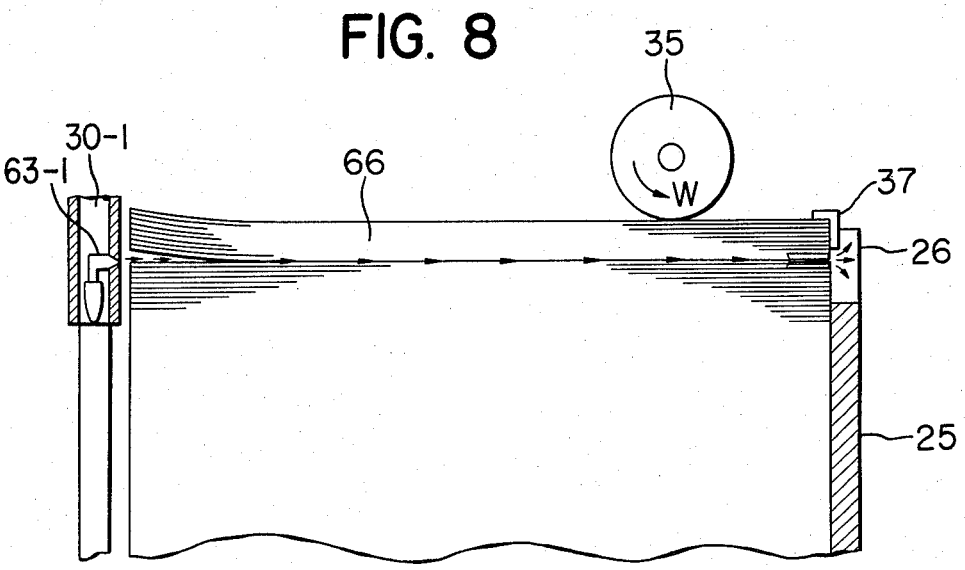
FIG. 8 is a cross-sectional view of the storage taken along line 8—8 in FIG. 2A.

Referring to FIG. 8 which is a cross-section taken along line 8—8 in FIG. 2A, the air from the nozzle 63-1 is blown between the paper leaves 66 opposed to this nozzle. Since the level of this nozzle is about 2 to 3 mm below the uppermost level of the piled paper leaves 66, the air passes between the paper leaves as indicated by arrows and discharges outwardly through cut-away portions of the front plate 25 formed at the opposite ends of the projected portion 26. Since the projected portion 26 is located in the path of the air with its opposite ends cut away, the air may discharge out of the piled paper leaves through such cut-aways (exhaust ports) with a very low resistance encountered and accordingly, the pressure of the air may be low.

In short, the paper leaves above the level indicated by arrows are separated as if they were riding on an air cushion but, even under such condition, their position is restricted by the projected portion 26 and the separating pawls 37-1, 37-2, so that a predetermined position of the paper leaves is maintained.

According to the present invention, as described hitherto, discharge ports are provided at the opposite end of the storage from that end whereat the nozzle is disposed, so that the air passed between the paper leaves may be discharged out of the storage, whereby a flow path of the air from the nozzle may be formed to impart separability to the paper leaves very accurately and under a low air pressure.

Further, according to the present invention, the nozzles 63 are fixedly provided to the L-shaped members 30 and thus, by opening the keep member 29 (door member) for the supply of paper into the storage, the nozzles are also retracted so as not to interfere with the paper supply, which means great ease of the paper supply to the storage.

The paper leaves 66 given such separability are fed one by one from the top by the rollers 35, as already noted, but if the distance between the top and the air passageway indicated by arrows is extremely small and when the roller 35 is driven with the air blown, those of the paper leaves which lie above the air level might all be fed at one time because the resistance on the air level indicated by arrows is extremely low.

Accordingly, the present invention overcomes such disadvantage by blowing the air intermittently and in timed relationship with the rotation of the rollers 35.

More particularly, once the rollers 35 have started to be driven in the direction of arrow W and an uppermost paper leaf has begun to be moved, a minute air layer is formed below this paper leaf to ensure smooth movement of the paper leaf. Therefore, the injection of the air from the nozzle 63-1 is stopped at least at the point of time whereat the rollers 35 starts to be driven.

Figure 9:
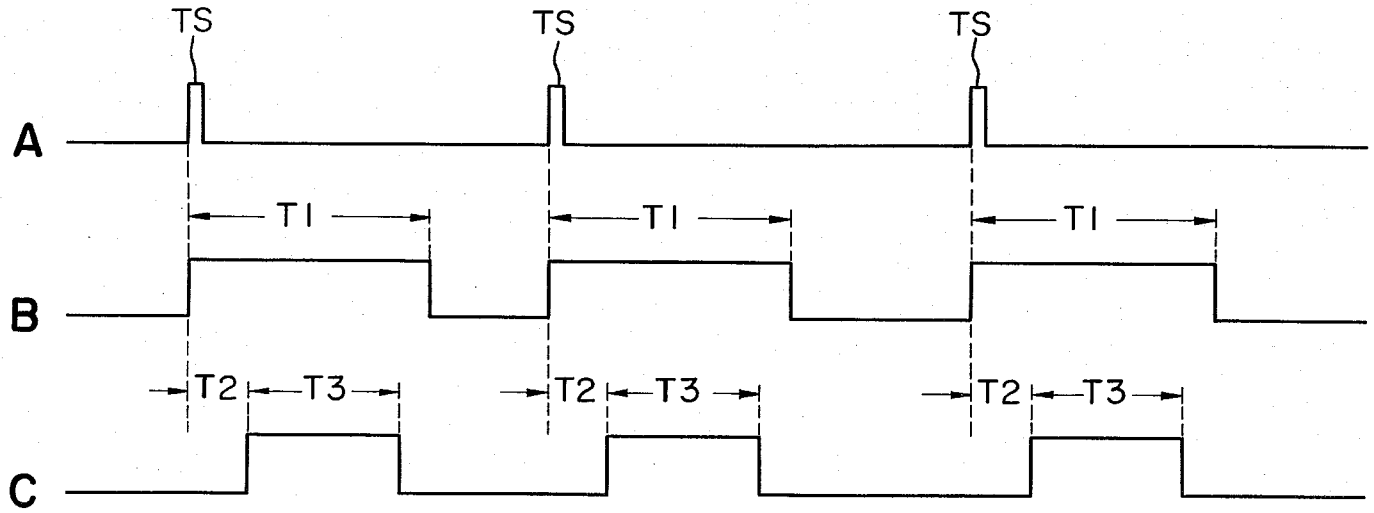
FIG. 9 is a timing chart for illustrating the drive timing between the roller and the nozzle.
Figure 10:
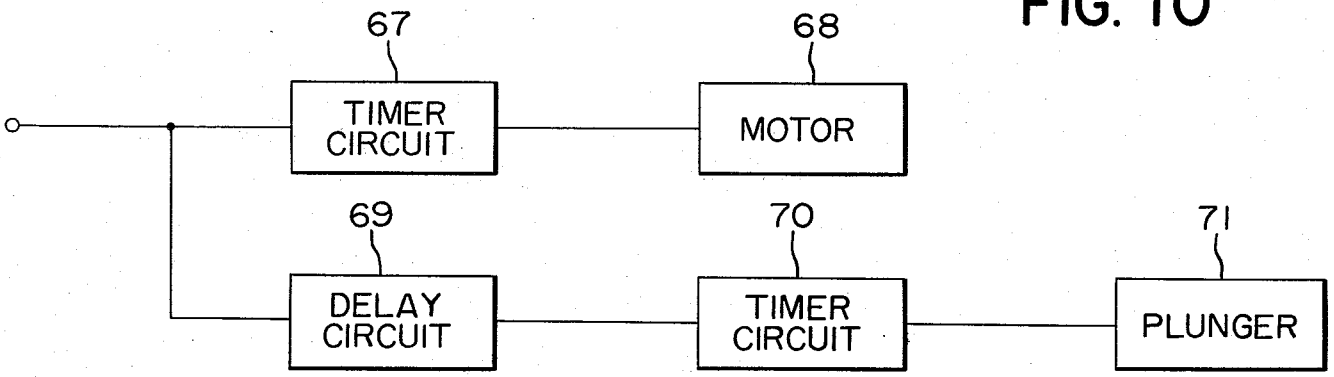
FIG. 10 is a diagram of the drive circuit for driving the roller and the nozzle with the timing as shown in FIG. 9.

FIGS. 9 and 10 are a timing chart and a circuit diagram, respectively, for illustrating the timing between such rollers 35 and the air blown from the nozzle 63-1. Upon application of trigger signal TS as shown by A in FIG. 9, a timer circuit 67 having a time T1 is operated to form a signal such as B for driving the rollers 35 for the time T1 after the application of the trigger signal, and such signal is applied to a motor 68 for driving the rollers 35 to feed a paper leaf. On the other hand, the trigger signal TS is also introduced into a delay circuit 69 having a time T2, whereafter it is further introduced into a timer circuit 70 having a time T3, from which there is produced a signal as shown in FIG. 9C, and such signal is applied to a plunger 71 which controls the supply of air to the nozzle 63-1 so that air is supplied to the nozzle 63 only during the times T3 shown in FIG. 9C.

Here, if T1 is set to $T1 > T2 + T3$, no air is blown from the nozzle 63 when the rollers 35 start to be driven, thus ensuring paper leaves to be fed one by one by the rollers 35. A microswitch 72 is disposed below the aforementioned top plate. The detecting terminal 73 of such microswitch 72 is opposed to the uppermost surface of the piled paper leaves and when the detecting terminal 73 comes out of contact with the uppermost surface of the paper leaves because of the lowering of such surface, the microswitch 72 is closed to energize the motor for driving the aforementioned gear 21, thereby moving the movable bed 18 upwardly. With such movement, the detecting terminal 73 again comes into contact with the then uppermost surface of the paper leaves, whereupon the microswitch 72 is opened to deenergize the motor for driving the gear 21. In this manner, the motor for driving the gear 21 is controlled to ensure that the uppermost surface of the paper leaves lie at a predetermined level.

What we claim is:

1. A paper feed device comprising:

means for storing a stack of paper leaves to be fed;

means, located above said storage means, for feeding the topmost paper leaf on the stack in a forward direction;

means, located at the front end of said storage means, for separating the topmost paper leaf from the stack to allow said feeding means to feed the topmost paper leaf only;

blowing means for applying pressurized air from adjacent the rear end of the stack in the forward direction at a position remote from the topmost leaf to render the leaves easily separable from adjacent leaves; and control means for actuating said blowing means at a predetermined time after said feeding means starts to feed the topmost leaf from said stack.

* * * * *